US005476546A

United States Patent [19]

Zibulla

[11] Patent Number: 5,476,546

[45] Date of Patent: Dec. 19, 1995

[54] APPARATUS FOR APPLYING LUBRICANT PATTERN TO A SHEET WORK PIECE

[75] Inventor: Georg G. Zibulla, Hagen, Germany

[73] Assignee: Firma Zibulla & Sohn GmbH Raziol-Schmierungstechnik, Iserlohn-Letmathe, Germany

[21] Appl. No.: 129,488

[22] Filed: Sep. 30, 1993

Related U.S. Application Data

[63] Continuation of Ser. No. 827,974, Jan. 29, 1992, abandoned.

[30] Foreign Application Priority Data

Feb. 21, 1991 [DE] Germany ..... 41 05 364.8

[51] Int. Cl.[6] ..... B05C 1/10

[52] U.S. Cl. ..... 118/668; 118/669; 118/681; 118/684; 118/209; 118/211; 118/221; 118/222; 118/223; 118/224; 118/225; 118/226; 118/227; 118/255; 118/DIG. 15; 118/117; 118/118; 118/216; 118/252; 184/17; 226/189; 226/199

[58] Field of Search ..... 226/15, 108, 10, 226/183, 189, 199; 118/668, 669, 679, 680, 681, 684, 685, 696, 697, 211, 221, 222, 223, 224, 225, 226, 227, 255, 258, DIG. 15, 117, 118, 216, 246, 207, 209, 252, 230, 231, 261, 262; 184/101, 17

[56] References Cited

U.S. PATENT DOCUMENTS

| | | | |
|---|---|---|---|
| 2,573,097 | 10/1951 | Epstein | 68/203 |
| 2,775,953 | 1/1957 | McFall | 118/227 |
| 2,836,415 | 5/1958 | Rohdin | 226/185 |
| 2,925,800 | 2/1960 | Wassem | 118/681 |
| 3,416,489 | 12/1968 | Hoffmann | 118/227 |
| 3,590,778 | 7/1971 | Mozzi, Jr. | 118/682 |
| 3,616,742 | 11/1971 | Boyle et al. | 118/224 |
| 3,620,633 | 11/1971 | Chauvoz | 401/147 |
| 3,710,469 | 1/1973 | Kitawaza | 118/227 |
| 3,890,504 | 6/1975 | Pendleton et al. | 250/325 |
| 3,933,415 | 1/1976 | Woolpert | 401/145 X |
| 4,033,283 | 7/1977 | Rusk | 118/681 |
| 4,205,770 | 6/1980 | Wojdyla | 226/49 |
| 4,232,064 | 11/1980 | Nicklas et al. | 118/681 |
| 4,448,016 | 5/1984 | Thalmann | 57/133 |
| 4,485,982 | 12/1984 | St. John et al. | 242/57.1 |
| 4,527,474 | 7/1985 | Lubke et al. | 101/247 |
| 4,535,611 | 8/1985 | Masuda | 401/197 |
| 4,643,130 | 2/1987 | Sheath et al. | 118/681 |
| 4,660,471 | 4/1987 | Wright, Jr. et al. | 101/219 |
| 4,728,800 | 3/1988 | Surka | 250/572 |
| 4,736,703 | 4/1988 | Mattei et al. | 118/221 |
| 4,865,872 | 9/1989 | Pellatiro | 118/669 |
| 4,961,378 | 10/1990 | Balow et al. | 101/142 |
| 5,052,296 | 10/1991 | Shiba | 101/227 |
| 5,098,507 | 3/1992 | Mao | 156/351 |
| 5,152,522 | 10/1992 | Yamashita | 271/264 |

FOREIGN PATENT DOCUMENTS

| | | | |
|---|---|---|---|
| 3246891A1 | 6/1984 | Germany . | |
| 3507845C1 | 6/1986 | Germany . | |
| 3507846C1 | 8/1986 | Germany . | |
| 90 02 016.6 | 6/1991 | Germany . | |
| 47-12354 | 4/1972 | Japan | 118/211 |
| 461415 | 12/1990 | Sweden . | |
| 899187 | 1/1982 | U.S.S.R. . | |

*Primary Examiner*—W. Gary Jones
*Assistant Examiner*—Mark De Simone
*Attorney, Agent, or Firm*—Herbert Dubno; Andrew Wilford

[57] ABSTRACT

An apparatus for applying a liquid lubricant in a pattern to a face of a sheet workpiece has a support frame through which the workpiece is transported in a travel direction substantially parallel to its face, a plurality of axles in the frame extending along respective axes generally perpendicular to the direction and individually displaceable generally perpendicular to the direction and to the respective axes, and respective liquid-pervious rollers journaled on the axles about the respective axes. A liquid lubricant is fed to the rollers and respective actuators connected between the axles and the frame displace the respective rollers perpendicular to the direction and to the respective axes into and out of contact with the workpiece as same passes in the direction through the frame. A controller connected to the actuators individually controls and operates same to apply the liquid lubricant in the rollers to the workpiece in a predetermined pattern as the workpiece passes through the frame.

13 Claims, 5 Drawing Sheets

15
17
18
19
20
21
16
22
11
T
24
Z
T17
T21
T18
5Z
4Z
26Z

APPARATUS FOR APPLYING LUBRICANT PATTERN TO A SHEET WORK PIECE

CROSS REFERENCE TO RELATED APPLICATIONS

This application is a file-wrapper-continuation of now abandoned patent application 07/827,974 filed Jan. 29, 1992 with a claim to the priority of German patent application P 41 05 364.8 filed Feb. 21, 1991.

FIELD OF THE INVENTION

The present invention relates to an apparatus for applying a lubricant grease to a sheet workpiece. More particularly this invention concerns applying such a lubricant to a workpiece in a pattern as the workpiece passes through the lubricant-applying machine.

BACKGROUND OF THE INVENTION

In certain deep-drawing, stamping, and similar deformation operations with no material removal it is necessary to lubricate the zones of the sheet workpiece that are to be deformed, but at the same time those portions of the workpiece that are to be clamped must be left dry so that the workpiece does not slip when being worked on. The lubricant facilitates deformation of the workpiece by allowing it to slide on any dies or punches that engage it.

The traditional method of applying a pattern of lubricant to the workpiece is to spray the lubricant on. This procedure is fairly messy and entails considerable problems in containing the spray and controlling and treating the vapors generated by the sprays.

Accordingly German patent document 3,507,846 describes a system where the workpiece is passed in contact with applicator rollers having liquid-pervious coverings. The lubricant can be selectively fed to the interior of any of the rollers so that it passes out through the roller cover and wets the workpiece that is rolled under it, thereby producing a greased strip where a workpiece face engages a lubricant-filled roller, while the unfilled rollers leave the workpiece face fairly dry.

Such a system has two main disadvantages. First, the lubricant can normally only be applied in stripes extending parallel to the workpiece displacement direction. Even so when grease feed to a particular roller is stopped, the roller continues to apply lubricant to workpieces until its supply has been exhausted and the roller is substantially dry. Furthermore after feeding grease to a given roller it takes some time before it can apply a uniform coat to a workpiece engaging it. Thus if the striping is to be changed it is necessary to run several workpieces through the lubricator to clear out the residual grease before the new pattern will be applied accurately.

The second disadvantage is that there are invariably dry stripes left between adjacent rollers. The mounting equipment invariably takes up some room, so that there will inherently be voids between adjacent grease stripes on the workpiece.

OBJECTS OF THE INVENTION

It is therefore an object of the present invention to provide an improved apparatus for applying lubricant in a pattern in a workpiece to be deformed.

Another object is the provision of such an improved apparatus for applying lubricant in a pattern in a workpiece to be deformed which overcomes the above-given disadvantages, that is which can apply the lubricant in any type of complex pattern, even one that varies in the workpiece travel direction, that can change patterns easily from one workpiece to the next, and that can lubricate any region of a workpiece face.

SUMMARY OF THE INVENTION

An apparatus for applying a liquid lubricant in a pattern to a face of a sheet workpiece has a support frame through which the workpiece is transported in a travel direction substantially parallel to its face and a plurality of axles in the frame extending along respective axes generally perpendicular to the direction. The axles are individually displaceable generally perpendicular to the direction and to the respective axes, and respective liquid-pervious rollers journaled are on the axles about the respective axes. A liquid lubricant is fed to the rollers and respective actuators connected between the axles and the frame displace the respective rollers perpendicular to the direction and to the respective axes into and out of contact with the workpiece as same passes in the direction through the frame. A controller connected to the actuators individually controls and operates same to apply the liquid lubricant in the rollers to the workpiece in a predetermined pattern as the workpiece passes through the frame.

Thus with the system according to this invention it is possible to form a pattern than can vary in and perpendicular to the workpiece transport direction. This makes it possible to form a fairly complex pattern on the workpiece face to conform to a complex deep-drawing or deforming operation.

In accordance with the invention some of the rollers are offset in the travel direction from others of the rollers and are also offset axially with respect to the other rollers so that coaxial rollers form gaps that are aligned in the direction with other rollers for full coverage. More particularly, the rollers are arrayed in first and second groups with the axes of the first group coaxial and the axes of the second group also coaxial and parallel to the first-group axes. The rollers of the second group are axially offset from and staggered relative to those of the first group.

Furthermore according to the invention respective mounts rotatably support the roller axes and are each provided with a guide supporting the mount and respective roller on the frame for movement perpendicular to the respective axis and to the travel direction. The actuators are connected between the respective mounts and the frame. Each actuator has one end connected to the respective mount and an opposite end connected to the frame and one of the ends of each actuator is carried with some play to permit some displacement of the respective roller when pressed by the respective actuator against the workpiece. More particularly the one actuator ends are the ends connected to the frame and the frame is formed with a hole through which the one actuator ends pass with play. A spring is braced between each mount and the frame for supporting the weight of the respective roller and mount.

According to another inventive feature one or more drives are provided for rotating the rollers at a peripheral speed generally equal to a travel speed of the workpiece in the transport direction. These drives can each be a respective pneumatic motor.

The lubricant can be fed to each of the rollers, which are constituted as perforated metal cylinders covered with a liquid-pervious textile, through a valve operated by the controller for cutting off the supply of the lubricant to an unused roller. The lubricant feed is connected to the axles of the rollers and the valves are of variable flow cross section.

A light curtain or the like is provided for detecting the workpiece position so that the actuators are operated by the controller in accordance with workpiece position. In addition to maintain an accurate workpiece position guides are provided flanking the workpiece in the transport direction and maintaining same at a predetermined position relative to the rollers as the workpiece moves through the frame. Also, each roller is displaceable and fixable in a direction perpendicular to the transport direction.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
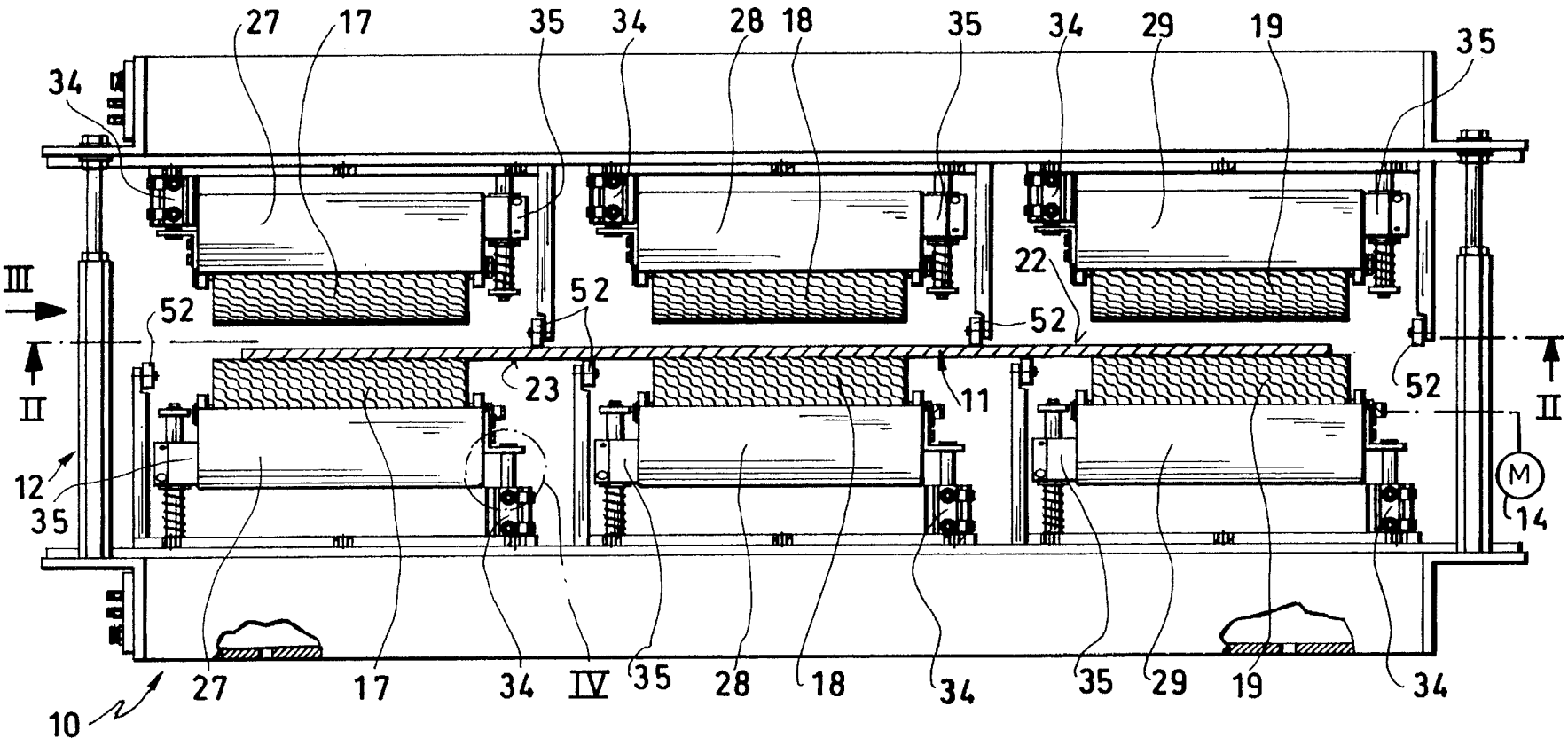
FIG. 1 is an end view of the apparatus according to the invention.
Figure 2:
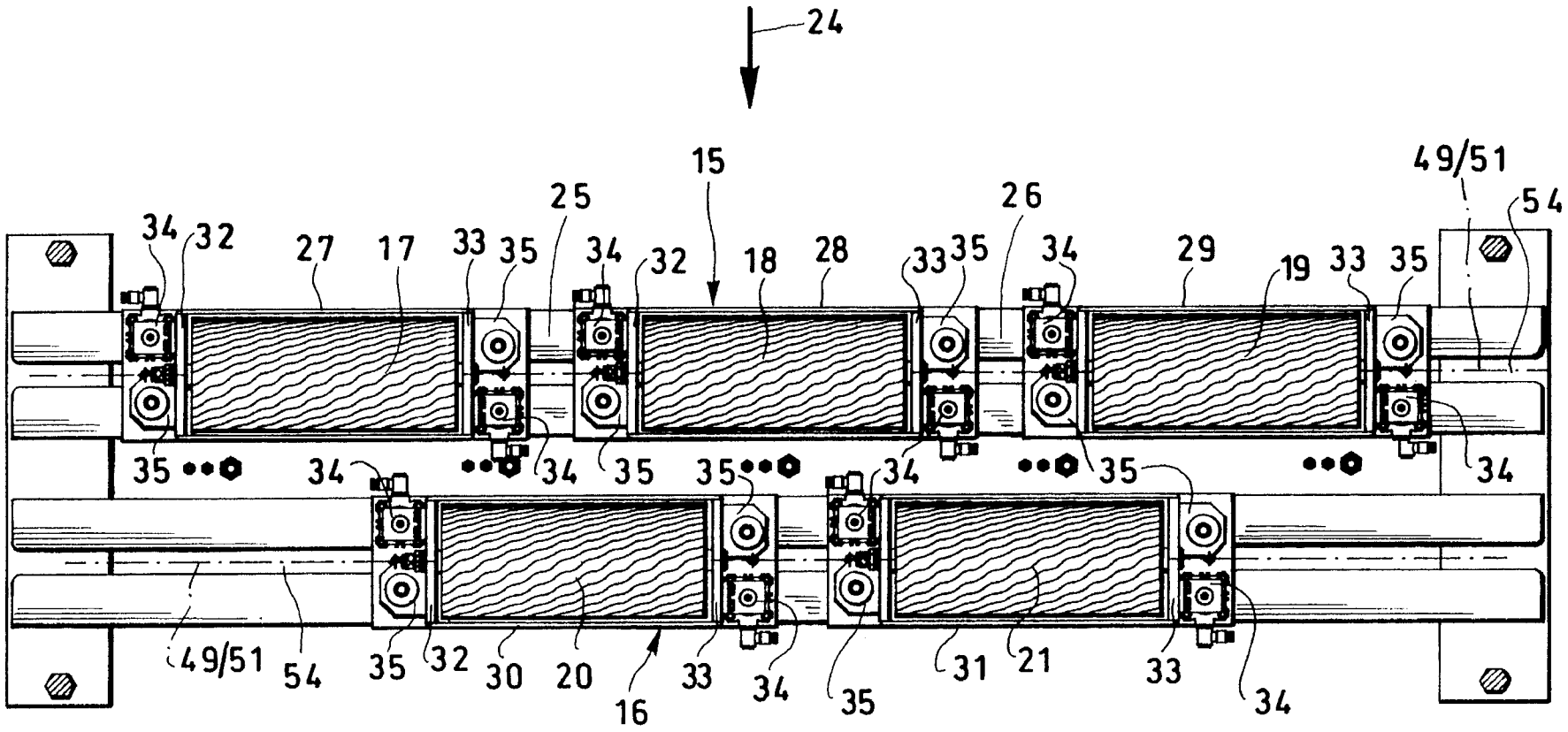
FIG. 2 is a horizontal section taken along line II—II of FIG. 1.
Figure 3:
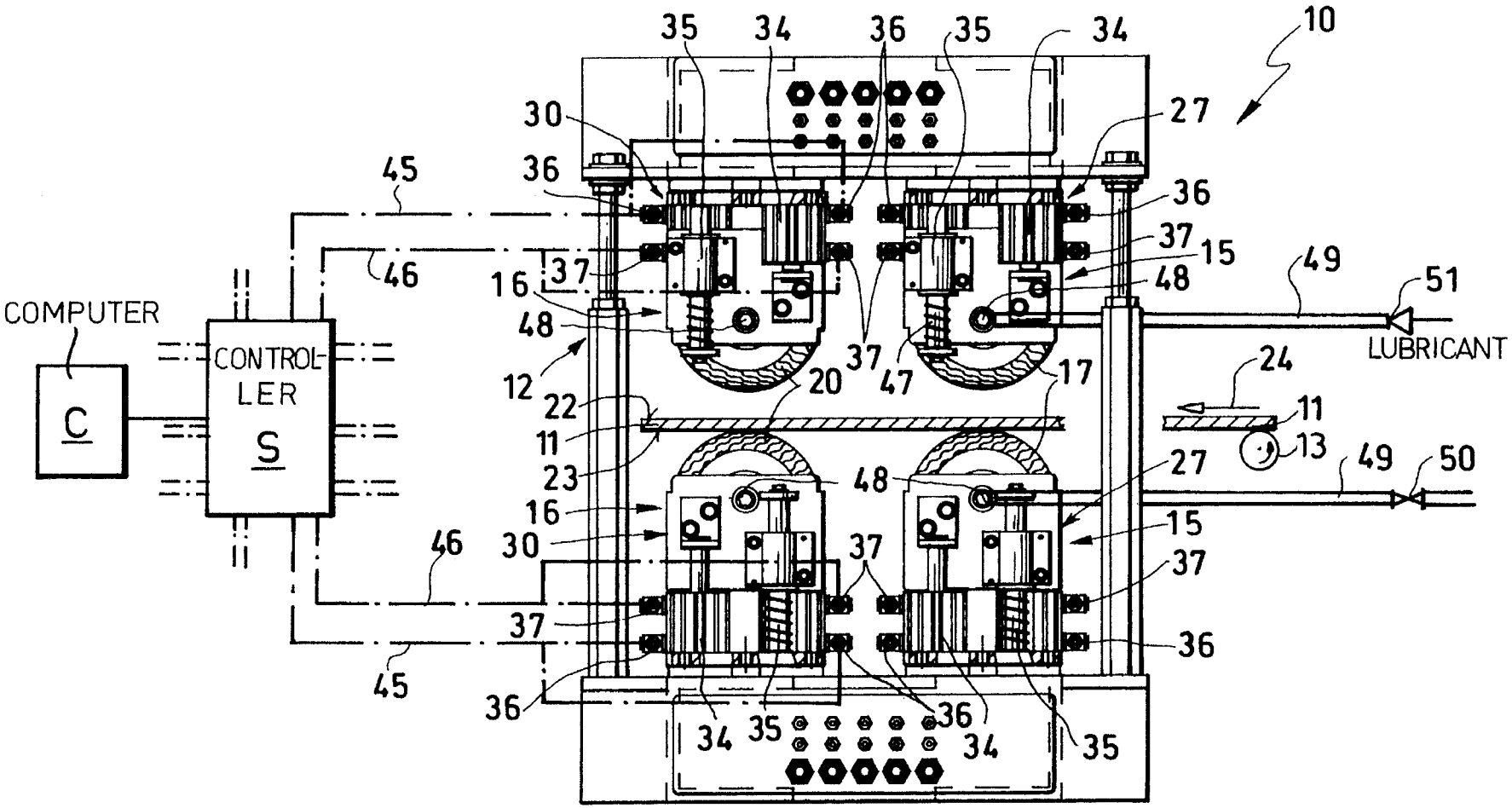
FIG. 3 is a partly diagrammatic side view according to arrow III of FIG. 1.

As seen in FIGS. 1 through 3 the apparatus 10 according to this invention has a frame 12 through which a flat planar workpiece 11 having upper and lower faces 22 and 23 is passed in a horizontal transport direction 24 by a drive illustrated schematically at 13. Above and below the workpiece 11 are upstream and downstream rows 15 and 16 of rollers 17 - - - 21 held in respective support casings or frames 27 - - - 31 each vertically displaceable by a pair of diagonally opposite actuators 34 on a pair of diagonally opposite ball-roller guides 35 secured to casing ends 32 and 33. The support casings 27 - - - 31 can be moved and locked in place along T-slots 54 extending horizontally perpendicular to the direction 24. In any case the rollers 20 and 21 of the downstream row 16 are aligned with gaps 25 and 26 between the rollers 17, 18, and 19 of the upstream row 15. Furthermore each roller 17 - - - 21 can be associated with a respective drive such as a pneumatic motor shown schematically at 14 in FIG. 1 to rotate the rollers 17 - - - 21 at a peripheral speed equal to the travel speed of the workpiece 11 in direction 24. The workpiece 11 itself is held on center by guide rollers 52 that maintain it at an exact vertical position relative to the frame 12.

Figure 4:
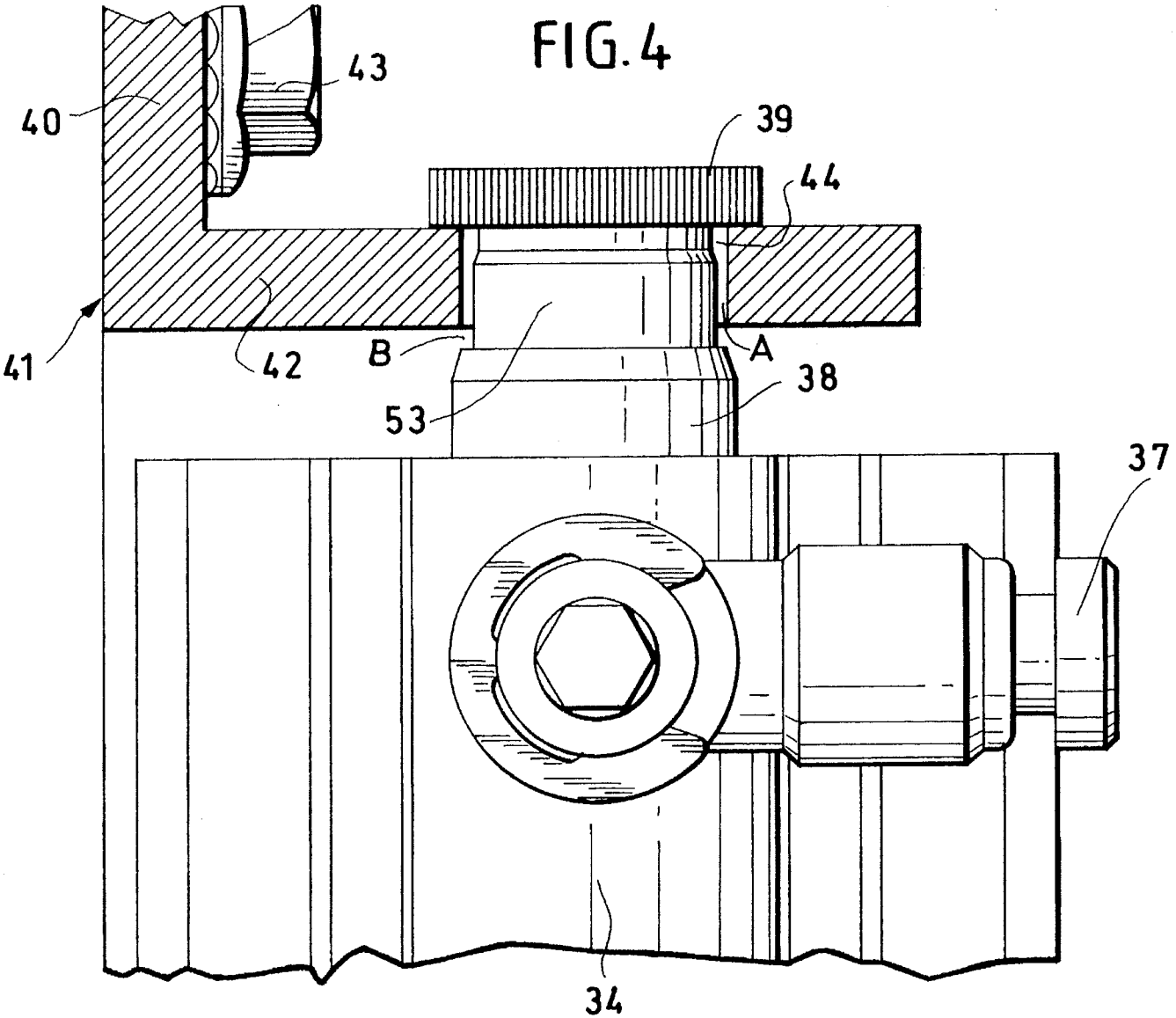
FIG. 4 is a large-scale view of the detail indicated at IV in FIG. 1.

Each actuator 34 is a double-acting fluid-powered cylinder having pressurizable feed lines 36 and 37 (see FIG. 3) that open into compartments flanking an unillustrated piston. In addition as seen in FIG. 4 each actuator 34 has a piston rod 38 whose upper end 53 passes through a hole 44 in a leg 42 of an angle bracket 41 whose other leg 40 is secured by a bolt 43 to the machine frame 12. A nut 39 sits atop the bracket leg 42 and the rod end 53 is received with lateral play A in the hole 44 and has some vertical play B also so that the rollers 17 - - - 21 can move somewhat relative to the frame 12 to compensate for some vertical movement of the workpiece 11. In addition each guide 35 is surrounded by a compression spring 47 positioned to take up the weight of the respective roller assembly so that the actuators 34 basically are only displacing and holding the respective rollers 17 - - - 21, not actually carrying their weights.

The apparatus is controlled by a controller S (FIG. 3) associated with a computer C and connected via lines 45 and 46 to the inputs 36 and 37, and to valves 50 and 51 in lines 49 that feed a liquid lubricant to hollow axles 48 that carry the rollers 17 - - - 21.

Figure 5:
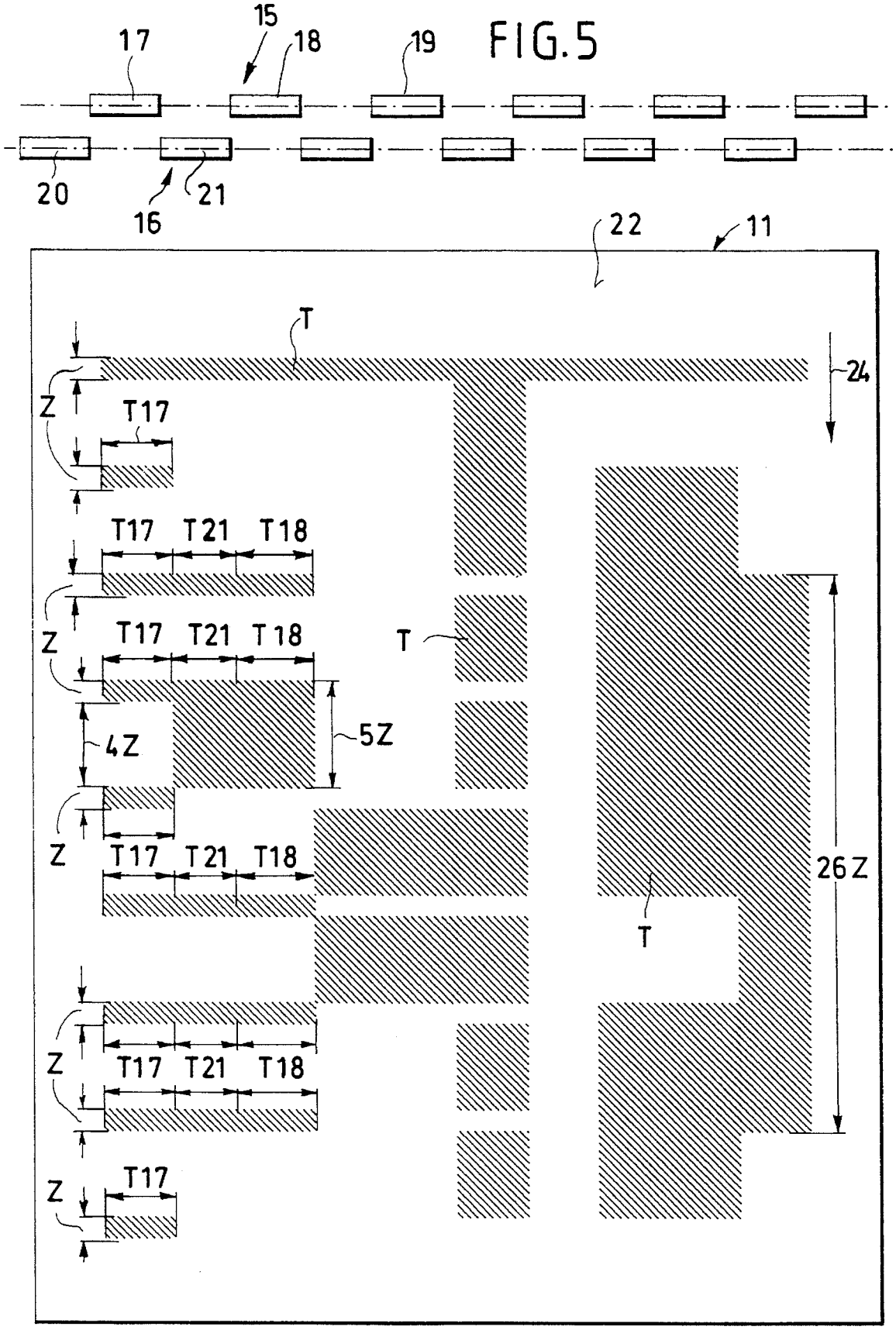
FIG. 5 is a diagrammatic view illustrating how the system of this invention works.

The controller C can operate the actuators 34 of the rollers 17 - - - 21 individually to press them against the respective workpiece face 22 or 23 for a time at least equal to Z to form on the workpiece face 22 a spot T as shown in FIG. 5. Thus the rollers 17 can form spots T17, the rollers 21 overlapping spots T21, the rollers 18 spots T18, and so on. The spots can have a minimum length corresponding to the time Z multiplied by the velocity of the workpiece 11 in direction 24 or can be as long as 26Z as shown on the right in FIG. 5.

I claim:

1. An apparatus for applying a liquid lubricant in a pattern to at least one of a pair of parallel faces of a sheet workpiece, the apparatus comprising:

a support frame;

means for transporting the workpiece in a travel direction substantially parallel to its faces through the support frame;

upstream and downstream axles in the frame extending along respective parallel upstream and downstream axes generally perpendicular to the direction and generally parallel to the workpiece faces;

support means carrying the axles on the frame for individual displacement generally perpendicular to a plane parallel to the direction, to the faces, and to the respective axes;

respective upstream and downstream liquid-pervious applicator rollers journaled on the axles about the respective axes, the upstream rollers being offset axially from each other and defining axially spaced gaps of predetermined relatively short axial lengths, the downstream rollers being offset axially from each other and being aligned in the travel direction with the gaps between the upstream rollers;

guide means engaging at least one of the faces of the workpiece and bearing on the workpiece transversely of the travel direction at locations offset from the applicator rollers for preventing movement of the workpiece transversely of the plane as the workpiece moves through the frame;

means for feeding a liquid lubricant to the rollers;

means including respective actuators connected between the axles and the frame for displacing the respective rollers perpendicular to the direction and to the respective axes into and out of contact with the workpiece as the workpiece passes in the direction through the frame;

control means connected to the actuators for individually controlling and operating the actuators and to the liquid-feed means to apply the liquid lubricant in the rollers to the workpiece in a predetermined pattern as the workpiece passes through the frame; and drive means for rotating the rollers at a peripheral speed generally equal to a travel speed of the workpiece in the transport direction even when the rollers are out of contact with the workpiece.

2. The lubricant-applying apparatus defined in claim 1 wherein each downstream roller is of a predetermined relatively long axial length that is greater than an axial length of the respective gap it is aligned with in the travel direction.

3. An apparatus for applying a liquid lubricant in a pattern to at least one of a pair of parallel faces of a sheet workpiece, the apparatus comprising:

a support frame;

means for transporting the workpiece in a travel direction substantially parallel to its faces through the support frame;

upstream and downstream axles in the frame extending along respective parallel upstream and downstream axes generally perpendicular to the direction and generally parallel to the workpiece faces;

support means carrying the axles on the frame for individual displacement generally perpendicular to a plane parallel to the direction, to the faces, and to the respective axes;

respective upstream and downstream liquid-pervious applicator rollers journaled on the axles about the respective axes, the upstream rollers being offset axially from each other and defining axially spaced gaps of predetermined relatively short axial lengths, the downstream rollers being offset axially from each other and being aligned in the travel direction with the gaps between the upstream rollers;

guide means including rollers engaging the workpiece axially between the rollers and bearing on the workpiece transversely of the travel direction at locations offset from the applicator rollers for preventing movement of the workpiece transversely of the plane as the workpiece moves through the frame;

means for feeding a liquid lubricant to the rollers;

means including respective actuators connected between the axles and the frame for displacing the respective rollers perpendicular to the direction and to the respective axes and out of contact with the workpiece as the workpiece passes in the direction through the frame;

control means connected to the actuators for individually controlling and operating the actuators and to the liquid-feed means to apply the liquid lubricant in the rollers to the workpiece in a predetermined pattern as the workpiece passes through the frame; and drive means for rotating the rollers at a peripheral speed generally equal to a travel speed of the workpiece in the transport direction even when the rollers are out of contact with the workpiece.

4. The lubricant-applying apparatus defined in claim 1, further comprising respective mounts rotatably supporting the roller axes and each provided with a guide supporting the respective mount and respective roller on the frame for movement perpendicular to the respective axis and to the travel direction, the actuators being connected between the respective mounts and the frame.

5. The lubricant-applying apparatus defined in claim 4 wherein each of the actuators has one end connected to the respective mount and an opposite end connected to the frame, one of the ends of each actuator being carried with some play to permit some displacement of the respective roller when pressed by the respective actuator against the workpiece.

6. The lubricant-applying apparatus defined in claim 5 wherein the one actuator ends are the ends connected to the frame and the frame is formed with a hole through which the one actuator ends pass with play.

7. The lubricant-applying apparatus defined in claim 4, further comprising respective spring means braced between the frame and each of mounts for supporting the weight of the respective roller and mount.

8. An apparatus for applying a liquid lubricant in a pattern to at least one of a pair of parallel faces of a sheet workpiece, the apparatus comprising:

a support frame;

means for transporting the workpiece in a travel direction substantially parallel to its faces through the support frame;

upstream and downstream axles in the frame extending along respective parallel upstream and downstream axes generally perpendicular to the direction and generally parallel to the workpiece faces;

support means carrying the axles on the frame for individual displacement generally perpendicular to a plane parallel to the direction, to the faces, and to the respective axes;

respective upstream and downstream liquid-pervious applicator rollers journaled on the axles about the respective axes, the upstream rollers being offset axially from each other and defining axially spaced gaps of predetermined relatively short axial lengths, the downstream rollers being offset axially from each other and being aligned in the travel direction with the gaps between the upstream rollers;

guide means engaging at least one of the faces of the workpiece and bearing on the workpiece transversely of the travel direction at locations offset from the applicator rollers for preventing movement of the workpiece transversely of the plane as the workpiece moves through the frame;

means for feeding a liquid lubricant to the rollers including a valve operated by the controller for cutting off the supply of the lubricant to an unused roller;

means including respective actuators connected between the axles and the frame for displacing the respective rollers perpendicular to the direction and to the respective axes into and out of contact with the workpiece as the workpiece passes in the direction through the frame;

control means connected to the actuators for individually controlling and operating the actuators and to the liquid-feed means to apply the fluid lubricant in the rollers to the workpiece in a predetermined pattern as the workpiece passes through the frame; and drive means for rotating the rollers at a peripheral speed generally equal to a travel speed of the workpiece in the transport direction even when the rollers are out of contact with the workpiece.

9. The lubricant-applying apparatus defined in claim 8 wherein the means for feeding the lubricant to the rollers is connected to the axles of the rollers.

10. The lubricant-applying apparatus defined in claim 8 wherein the valves are of variable flow cross section.

11. The lubricant-applying apparatus defined in claim 1 further comprising means connected to the control means for detecting the workpiece position, whereby the actuators are operated by the control means in accordance with workpiece position.

12. The lubricant-applying apparatus defined in claim 1 wherein each roller is displaceable and fixable in a direction perpendicular to the transport direction and to its respective axis.

13. The lubricant-applying apparatus defined in claim 1 wherein the drive means are each a pneumatic motor.

* * * * *